United States Patent [19]

Ono et al.

[11] 4,430,405

[45] Feb. 7, 1984

[54] XERORADIOGRAPHIC MATERIAL AND METHOD OF MAKING SAME

[75] Inventors: Yoshihiro Ono; Hiroshi Sunagawa, both of Asaka, Japan

[73] Assignee: Fuji Photo Film Co., Ltd., Tokyo, Japan

[21] Appl. No.: 421,071

[22] Filed: Sep. 29, 1982

[30] Foreign Application Priority Data

Oct. 1, 1981 [JP] Japan ..... 56-156695

[51] Int. Cl.[3] ..... G03G 5/087

[52] U.S. Cl. ..... 430/95; 430/84; 430/130; 430/136; 252/501.1; 427/74

[58] Field of Search ..... 430/84, 95, 130, 127, 430/135, 136; 252/501.1; 427/74

[56] References Cited

U.S. PATENT DOCUMENTS 4,254,200 3/1981 Thomann et al. ..... 430/84

FOREIGN PATENT DOCUMENTS 3024269 1/1981 Fed. Rep. of Germany ..... 430/84

*Primary Examiner*—Roland E. Martin, Jr.

*Attorney, Agent, or Firm*—Gerald J. Ferguson, Jr.; Joseph J. Baker

[57] ABSTRACT

A xeroradiographic material comprising a substrate at least one surface of which is electrically conductive, and an X-ray sensitive layer provided on the conductive surface of the substrate and essentially consisting of an organic binder, γ-form crystal grains of a bismuth oxide-based compound oxide and n-type semiconductor grains dispersed in the organic binder. The material is made by dispersing these grains in an organic binder solution, applying the dispersion onto the conductive surface of the substrate, drying the coat of the dispersion at a temperature in a range not lower than the boiling point of the solvent but below the softening point of the organic binder to form an X-ray sensitive layer, and heat-treating the X-ray sensitive layer at a temperature in a range not lower than the softening point of the organic binder but below the temperature at which the organic binder begins decomposing.

13 Claims, No Drawings

XERORADIOGRAPHIC MATERIAL AND METHOD OF MAKING SAME

BACKGROUND OF THE INVENTION

1. Field of the Invention

This invention relates to a xeroradiographic material and a method of making same.

2. Description of the Prior Art

Recently, body-centered cubic ($\gamma$-form) crystals of bismuth oxide-based compound oxides represented by the following general formula:

$$Bi_xMO_n$$

in which M designates at least one of germanium, silicon, titanium, gallium and aluminum, x denotes a number satisfying the condition $10 \leqq x \leqq 14$, and n denotes a number of oxygen atoms stoichiometrically determined depending on M and X, have attracted attention for use as photoconductive substances. The $\gamma$-form crystalline compound oxides become electrically conductive when exposed to X-rays. Therefore, it has been proposed in Japanese Unexamined Patent Publication No. 53(1978)-43531 to use them as photoconductive substances in xeroradiographic materials for forming electrostatic latent images by exposure to X-rays.

Xeroradiographic materials comprising a conductive substrate, and an X-ray sensitive layer formed of a dispersion containing the $\gamma$-form crystal grains of the above-mentioned compound oxides in an organic binder and provided on the conductive substrate exhibit a remarkably high sensitivity to X-rays. For example, it is known to use a xeroradiographic material comprising a conductive substrate, and an amorphous selenium layer deposited on the conductive substrate for mammography and the like. In general, compared with the xeroradiographic material comprising an amorphous selenium layer, the xeroradiographic materials provided with an X-ray sensitive layer formed of a dispersion containing the $\gamma$-form crystal grains of the above-mentioned compound oxides in an organic binder exhibit a sensitivity to X-rays about five to ten times higher.

When xeroradiographic materials are used for xeroradiography for the medical diagnostic purposes, it is desirable that the materials be as sensitive as possible to X-rays in order to minimize the exposure dose which patients receive. For this reason, it is desired to further increase the sensitivity of the xeroradiographic material comprising an X-ray sensitive layer formed of a dispersion containing the $\gamma$-form crystal grains of the above-mentioned compound oxides in an organic binder.

SUMMARY OF THE INVENTION

The primary object of the present invention is to provide a xeroradiographic material comprising an X-ray sensitive layer formed of a dispersion containing the $\gamma$-form crystal grains of bismuth oxide-based compound oxides in an organic binder, which exhibits an improved sensitivity to X-rays.

Another object of the present invention is to provide a method of making a xeroradiographic material comprising an X-ray sensitive layer formed of a dispersion containing the $\gamma$-form crystal grains of bismuth oxide-based compound oxides in an organic binder, which exhibits an improved sensitivity to X-rays.

The specific object of the present invention is to provide a xeroradiographic material comprising an X-ray sensitive layer formed of a dispersion containing the $\gamma$-form crystal grains of bismuth oxide-based compound oxides in an organic binder, which exhibits an improved sensitivity to X-rays and can be made in a simple way, and a method of making same.

To accomplish the above objects, the inventors conducted various studies on X-ray sensitive layers containing the $\gamma$-form crystal grains of the bismuth oxide-based compound oxides dispersed in an organic binder, and found that sensitivity of the X-ray sensitive layer to X-rays can be improved if n-type semiconductor grains are dispersed in an organic binder together with the $\gamma$-form crystal grains of the compound oxides described above to form an X-ray sensitive layer.

The xeroradiographic material in accordance with the present invention comprises a substrate at least one surface of which is electrically conductive, and an X-ray sensitive layer provided on the electrically conductive surface of said substrate, said X-ray sensitive layer essentially consisting of an organic binder, $\gamma$-form crystal grains of the bismuth oxide-based compound oxides and n-type semiconductor grains dispersed in said organic binder.

The xeroradiographic material in accordance with the present invention can be made by dispersing $\gamma$-form crystal grains of the bismuth oxide-based compound oxides and n-type semiconductor grains in an organic binder solution containing an organic binder dissolved in a solvent, applying the dispersion obtained onto an electrically conductive surface of a substrate at least one surface of which is electrically conductive, heating and drying the coat of the dispersion at a temperature within a range not lower than the boiling point of said solvent but below the softening point of said organic binder to form an X-ray sensitive layer on the electrically conductive surface. It was found that, if the X-ray sensitive layer thus formed on the electrically conductive surface of the substrate is further heat-treated at a temperature within a range not lower than the softening point of the organic binder but below the temperature at which the organic binder starts decomposing, the resulting X-ray sensitive layer exhibits a further improved sensitivity to X-rays.

Accordingly, the method of making a xeroradiographic material in accordance with the present invention comprises the steps of:

(a) dispersing $\gamma$-form crystal grains of the bismuth oxide-based compound oxide defined above and n-type semiconductor grains in an organic binder solution containing an organic binder dissolved in a solvent, (b) applying the dispersion thus obtained onto an electrically conductive surface of a substrate at least one surface of which is electrically conductive, (c) heating and drying the coat of the dispersion at a temperature within a range not lower than the boiling point of said solvent but below the softening point of said organic binder to form on said electrically conductive surface an X-ray sensitive layer essentially consisting of said organic binder, and said $\gamma$-form crystal grains of the bismuth oxide-based compound oxide and said n-type semiconductor grains dispersed in said organic binder, and thereafter (d) heat-treating the X-ray sensitive layer at a temperature within a range not lower than the softening point of said organic binder but below the temperature at which said organic binder begins decomposing.

DETAILED DESCRIPTION OF THE INVENTION

The present invention will hereinbelow be described in further detail.

The xeroradiographic material in accordance with the present invention is made by the process as described below.

First, a dispersion is prepared by dispersing the γ-form crystal grains of the bismuth oxide-based compound oxide defined above and the n-type semiconductor grains in an organic binder solution containing a suitable organic binder dissolved in a suitable solvent. The organic binders should be organic substances which do not adversely affect the γ-form crystal grains of the compound oxides and the n-type semiconductor grains and which can form a layer of a dispersion containing these grains. In general, any organic substances that are known to be capable of being used as binders in light-sensitive layers of electrophotographic materials can be used as the organic binders in the present invention. The solvents for dissolving the organic binders are selected suitably according to the kinds of the organic binders. In the present invention, from the view point of the sensitivity of the xeroradiographic materials obtained, it is also possible to use organic binders of the type exhibiting the charge carrier conveying capability and used in xeroradiographic materials disclosed, for example, in Japanese Unexamined Patent Publication No. 56(1981)-5549. This publication describes xeroradiographic materials comprising an X-ray sensitive layer formed by dispersing γ-form crystal grains of the bismuth oxide-based compound oxide in organic binders exhibiting the charge carrier conveying capability. Examples of the organic binders exhibiting the charge carrier conveying capability and the solvents suitable for such organic binders are described in the publication mentioned above.

The γ-form crystal grains of the bismuth oxide-based compound oxides can be obtained by pulverizing γ-form crystals (single crystal or polycrystal) of the compound oxides prepared by a known method such as Czochralski's method. The γ-form crystal grains of the compound oxides generally have a grain size of 1,000 μm or less, preferably 200 μm or less, more preferably 100 μm or less. In the present invention, from the view point of the sensitivity of the xeroradiographic materials obtained, the bismuth oxide-based compound oxides represented by the general formula mentioned above in which M denotes germanium and/or silicon, i.e. those represented by the formula:

$$Bi_x(Ge_{1-y}, Si_y)O_n$$

in which x and n have the meanings as defined above, and y denotes a number satisfying the condition $0 \leqq y \leqq 1$, are particularly preferable. Among these particularly preferable compound oxides, those represented by the formula just mentioned above in which x denotes 12, y denotes 0, and n denotes 20 (i.e. $Bi_{12}GeO_{20}$), and those of the formula in which x designates 12, y designates 1, and n designates 20 (i.e. $Bi_{12}SiO_{20}$) are further preferable.

In the present invention, the n-type semiconductor grains may be grains of C (diamond), $Mg_2Al_2O_4$, β-SiC, $TiO_2$, $V_2O_5$, $V_2O_4$, $MnO_2$, $Fe_2O_3$, $FeS_2$, ZnO, $Cu_2S$, $CuInSe_2$, ZnS, ZnSe, ZnTe, GeSe, SrO, $Nb_2O_5$, $Nb_2O_4$, $Nb_2O_3$, $MoO_3$, MoS, $MoS_2$, β-$Ag_2S$, β-$Ag_2Se$, β-$Ag_2Te$, CdS, InSe, SnO, $SnO_2$, SnSe, $Sb_2O_4$, $Ta_2O_3$, $Ta_2O_5$, $WO_3$, HgSe, $Bi_2S_3$, $Bi_2Se_3$, $CeO_2$, $Nd_2O_3$, $PbCrO_4$, HgS and the like. Of these n-type semiconductor grains, those of ZnO, CdS, $WO_3$ and $TiO_2$ are particularly preferable because of higher sensitivity of the xeroradiographic materials obtained. In general, n-type semiconductor grains having a grain size equial to or smaller than that of the γ-form crystal grains of the compound oxides are employed in the present invention.

The n-type semiconductor grains are generally used in a ratio within the range between 0.1% and 50% by volume, preferably between 1% and 30% by volume, more preferably between 3% and 10% by volume, based on the total of the γ-form crystal grains of the compound oxides and the n-type semiconductor grains. The organic binders are generally used in a ratio within the range between 1% and 90% by volume, preferably between 10% and 70% by volume, more preferably between 20% and 50% by volume, based on the total of the γ-form crystal grains of the compound oxides, the n-type semiconductor grains and the organic binders.

The dispersion is prepared by adding the γ-form crystal grains of the compound oxides and the n-type semiconductor grains to an organic binder solution containing an organic binder dissolved in a solvent, and intimately stirring the resulting mixture by an appropriate means. In this case, it is preferable that the γ-form crystal grains of the compound oxides and the n-type semiconductor grains be dispersed as primary particles in the organic binder solution.

Thereafter, the dispersion prepared as described above is uniformly applied to an electrically conductive surface of a substrate at least one surface of which is electrically conductive. For this purpose, any substrate may be used insofar as the surface on which the dispersion is applied, i.e. the surface on which an X-ray sensitive layer is formed, is electrically conductive. In general, metal plates are used as the substrates. Of the metal plates, aluminium plates, stainless steel plates or zinc plates are preferably used for there economy and ease of handling. The dispersion may be applied to the substrate by an ordinary method using a wire bar, a doctor blade, a roll coater, a knife coater or the like. In general, the dispersion is applied to the substrate in such an amount that the thickness of the X-ray sensitive layer after heating and drying is in the range between 10 μm and 2,000 μm, preferably between 30 μm and 800 μm, more preferably between 100 μm and 400 μm.

The coat of the dispersion applied to the substrate is then heated and dried. The heating and drying process is conducted for a sufficient length of time at a temperature within a range not lower than the boiling point of the solvent contained in the dispersion but below the softening point of the organic binder contained in the dispersion. In this process, the solvent is removed and an X-ray sensitive layer is formed on the substrate. The X-ray sensitive layer thus formed essentially consists of the organic binder, and the γ-form crystal grains of the compound oxide and the n-type semiconductor grains dispersed in the organic binder.

The xeroradiographic material in accordance with the present invention obtained by the method described above exhibits a higher sensitivity than xeroradiographic materials made in the same way as described above, except that the n-type semiconductor grains are not used. The extent of the improvement in sensitivity achieved by the use of the n-type semiconductor grains differs according to the kind of the n-type semiconductor grains used, and the like. However, for example, when ZnO, CdS, $WO_3$ or $TiO_2$ grains are used as the n-type semiconductor grains, the sensitivity of the xeroradiographic material obtained therefrom is, in general, about 1.5 to 2 times that of xeroradiographic material made without using the n-type semiconductor grains. The reason why the X-ray sensitive layer formed by dispersing the n-type semiconductor grains together with the γ-form crystal grains of the compound oxides in an organic binder exhibits an improved sensitivity has not completely clarified. However, it is presumed that the improved sensitivity is obtained for the reason described below. Namely, in the case of the X-ray sensitive layer formed of a dispersion containing only the γ-form crystal grains of the compound oxide in an organic binder, charge carriers generated in a γ-form crystal grain of the compound oxide due to excitation by X-rays can move only in that grain because the organic binder is an electrically insulating substance. On the other hand, in the case of the X-ray sensitive layer formed of a dispersion containing the n-type semiconductor grains together with the γ-form crystal grains of the compound oxide in an organic binder, it is presumed that the charge carriers, particularly electrons, generated in a γ-form crystal grain of the compound oxide can transfer more easily from the γ-form crystal grain into the n-type semiconductor grains.

When the X-ray sensitive layer formed on the substrate by the method described above is further heat-treated at a temperature within a range not lower than the softening point of the organic binder contained in the X-ray sensitive layer but below the temperature at which the organic binder begins decomposing, the sensitivity of the X-ray sensitive layer (i.e. the sensitivity of the xeroradiographic material) is further improved. In this heat treatment step, the heating temperature and the heating time must be strictly controlled to achieve sufficient improvement in sensitivity. Namely, when heat treatment is conducted at a temperature equal to or near to the softening point of the organic binder, it is necessary to conduct heat treatment for a relatively long time in order to obtain sufficient improvement in sensitivity. When heat treatment is conducted in the vicinity of the temperature at which the organic binder begins decomposing, a sufficient improvement in sensitivity can be obtained in a relatively short heating time. Particularly, when heat treatment is conducted in the vicinity of the temperature at which the organic binder begins decomposing, it is necessary to very strictly control the heat treatment time so that the X-ray sensitive layer may not be burnt or adversely affected. In general, the X-ray sensitive layer heat-treated as described above exhibits a sensitivity about 2 to 3 times higher than that before heat treatment. It is presumed that the sensitivity of the X-ray sensitive layer is improved by the heat treatment described above because the organic binder is softened by heat and, therefore, the contacting condition between the γ-form crystal grains of the compound oxide and the n-type semiconductor grains is improved.

The present invention will further be illustrated by the following nonlimitative examples.

EXAMPLE 1

Grains having a grain size in the range between 63 μm and 105 μm were obtained by pulverizing $Bi_{12}GeO_{20}$ γ-form single crystals prepared by the Czochralski method, and classifying the pulverized grains.

On the other hand, a polyester resin ("Vlyon 200" available from Toyobo Co., Ltd., Japan) was dissolved in tetrahydrofuran to prepare a 15 wt. % strength polyester resin solution.

Thereafter, the $Bi_{12}GeO_{20}$ γ-form crystal grains obtained as described above and n-type semiconductor grains were added to the polyester resin solution prepared as described above. The mixture thus obtained was intimately stirred to prepare a dispersion. In this case, the mixing ratio of the $Bi_{12}GeO_{20}$ γ-form crystal grains, the n-type semiconductor grains and the polyester resin was set so that their volume ratio after drying was 7:1:2. In this way, four kinds of dispersions were prepared by using ZnO grains ("SAZEX 4000" available from Sakai Chemical Industry Co., Ltd., Japan), CdS grains (available from Yamanaka Kagaku K.K., Japan), $WO_3$ grains (available from Mitsuwa Kagaku K.K., Japan), and $TiO_2$ grains (available from Yamanaka Kagaku K.K., Japan) as the n-type semiconductor grains.

Each of the dispersions prepared as described above was uniformly applied onto a 0.3 mm-thick aluminium plate by using a wire bar so that the thickness of the coat after drying was about 400 μm. Then, the coat of each dispersion applied on the aluminium plate was heated and dried for two hours at a temperature of 60° C. in the atmosphere, and further for 18 hours at a temperature of 140° C. in the atmosphere to form an X-ray sensitive layer on the aluminium plate. In this way, xeroradiographic material specimens Nos. 1 to 4 were obtained.

On the other hand, comparative xeroradiographic material specimens Nos. 5 and 6 were prepared in the same way as described above, except that the n-type semiconductor grains were not used and that the mixing ratio of the $Bi_{12}GeO_{20}$ γ-form crystal grains to the polyester resin was set so that the volume ratio between them after drying was 7:3 and 4:1, respectively.

Each of the specimens obtained as described above was then corona-discharged at a corona voltage of −5 kV in the dark, and exposed to X-rays while the surface potential was measured by use of a surface potential meter (SSV-II-50 available from Kawaguchi Denki K.K., Japan). The conditions for exposure to X-rays were as follows:

- X-ray generator/controller: KXO-15 available from Toshiba Corporation, Japan.
- X-ray tube: DRX-190A available from Toshiba Corporation, Japan.
- Tube voltage: 80 kV.
- Tube current: 1 mA.
- Distance from focal point to xeroradiographic material: 1 m.
- Exposure mode: Continuous.
- Exposure dose rate at xeroradiographic material surface: 4.7 mR/sec. (measured with Model 500 dosimeter available from VICTOREEN Company).

To evaluate the sensitivity to X-rays, the exposure dose (half attenuation exposure dose) required to reduce the surface potential of the xeroradiographic material just prior to the exposure to X-rays (initial potential) to half was measured. The results were as shown in Table 1 below.

As clearly shown in Table 1, the xeroradiographic materials (specimens Nos. 1 to 4) in accordance with the present invention exhibited a sensitivity about 1.5 to 2 times higher than those of the xeroradiographic materials (specimens Nos. 5 and 6) which were made in the same way as in the present invention, except that the n-type semiconductor grains were not used.

TABLE 1

| Specimen No. | n-Type semiconductor grains | Initial Potential (V) | Half attenuation exposure dose (mR) |
|---|---|---|---|
| 1 | ZnO | −500 | 28 |
| 2 | CdS | −590 | 32 |
| 3 | $WO_3$ | −500 | 33 |
| 4 | $TiO_2$ | −540 | 35 |
| 5 | — | −520 | 54 |
| 6 | — | −500 | 56 |

EXAMPLE 2

A resin mixture containing the same polyester resin as used in Example 1 and an alkyd resin ("Beckolite" available from Dainippon Ink And Chemicals, Incorporated, Japan) in a volume ratio 17:3 was dissolved in a solvent mixture containing methyl ethyl ketone and toluene in a weight ratio 1:4. In this way, a 20 wt. % strenght solution of the resin mixture was prepared.

Thereafter, the same $Bi_{12}GeO_{20}$ γ-form crystal grains as used in Example 1 and ZnO grains were added to the solution of the resin mixture, and the mixture was intimately stirred to prepare a dispersion. In this case, the mixing ratio of $Bi_{12}GeO_{20}$ γ-form crystal grains, the ZnO grains and the resin mixture was set so that their volume ratio after drying was 15:1:4.

The dispersion thus obtained was then uniformly applied onto a 0.3 mm-thick aluminium plate by using a wire bar in the same way as described in Example 1 so that the thickness of the coat after drying was about 300 μm. Then, the coat of the dispersion applied on the aluminium plate was heated and dried for two hours at a temperature of 60° C. in the atmosphere, and further for 26 hours at a temperature of 140° C. in a vacuum dryer to form an X-ray sensitive layer on the aluminium plate. In this way, three xeroradiographic material specimens of the same type were made, one of which was taken as specimen No. 7.

Two remaining specimens were heat-treated for one hour at a temperature of 220° C. (which was higher than the softening point of the above-mentioned resin mixture but lower than the temperature at which the resin mixture begins decomposing) in the atmosphere (first heat treatment). One of the two xeroradiographic material specimens thus heat-treated was taken as specimen No. 8. Thereafter, the other of the two specimens was further heat-treated for three minutes at a temperature of 330° C. (which was higher than the softening point of the above-mentioned resin mixture but lower than the temperature at which the resin mixture begins decomposing) in nitrogen gas (second heat treatment). The xeroradiographic material thus heat-treated was taken as specimen No. 9.

The half attenuation exposure dose was measured on specimen Nos. 7 to 9 thus obtained in the same way as described in Example 1. The results were as shown in Table 2.

As clearly shown in Table 2, the xeroradiographic material (specimen No. 8) comprising a X-ray sensitive layer formed thereon and subjected to the first heat treatment, and the xeroradiographic material (specimen No. 9) subjected to the first heat treatment and the second heat treatment exhibited a sensitivity about 2 to 2.5 times higher than those of the xeroradiographic material (specimen No. 7) which was not subjected to the heat treatment.

TABLE 2

| Specimen No. | Initial Potential (V) | Half attenuation exposure dose (mR) |
|---|---|---|
| 7 | −500 | 21 |
| 8 | −500 | 11 |
| 9 | −500 | 8 |

What is claimed is:

1. A xeroradiographic material comprising a substrate at least one surface of which is electrically conductive, and an X-ray sensitive layer provided on the electrically conductive surface of said substrate, said X-ray sensitive layer essentially consisting of an organic binder, (i) γ-form crystal grains of a bismuth oxide-based compound oxide represented by the following general formula:

$$Bi_xMO_n$$

in which M designates at least one of germanium, silicon, titanium, gallium and aluminum, x denotes a number satisfying the condition $10 \leqq x \leqq 14$, and n denotes a number of oxygen atoms stoichiometrically determined depending on M and x, and (ii) inorganic n-type semiconductor grains, said constituents (i) and (ii) being dispersed in said organic binder.

2. A xeroradiographic material as defined in claim 1 wherein said n-type semiconductor grains are selected from the group consisting of ZnO, CdS, $WO_3$ and $TiO_2$ and mixtures thereof.

3. A xeroradiographic material as defined in claim 1 or 2 wherein said organic binder exhibits charge carrier conveying capability.

4. A xeroradiographic material as defined in any of claims 1 or 2 wherein M in said general formula designates germanium and/or silicon.

5. A xeroradiographic material as defined in claim 1 wherein said bismuth oxide-based compound oxide is represented by said general formula in which M designates germanium, x denotes 12, and n denotes 20.

6. A xeroradiographic material as defined in claim 1 wherein said bismuth oxide-based compound oxide is represented by said general formula in which M designates silicon, x denotes 12, and n denotes 20.

7. A method of making a xeroradiographic material comprising the steps of:

(a) dispersing (i) γ-form crystal grains of a bismuth oxide-based compound oxide represented by the following general formula:

$$Bi_xMO_n$$

in which M designates at least one of germanium, silicon, titanium, gallium and aluminum, x denotes a number satisfying the condition $10 \leqq x \leqq 14$, and n denotes a number of oxygen atoms stoichiometrically determined depending on M and x, and (ii) n-type semiconductor grains in an organic binder solution containing an organic binder dissolved in a solvent, (b) applying the dispersion thus obtained onto an electrically conductive surface of a substrate at least one surface of which is electrically conductive, and (c) heating and drying the coat of the dispersion at a temperature within the range not lower than the boiling point of said solvent but below the softening point of said organic binder to form on said electrically conductive surface an X-ray sensitive layer essentially consisting of said organic binder, and said $\gamma$-form crystal grains of the bismuth oxide-based compound oxide and said n-type semiconductor grains dispersed in said organic binder.

8. A method as defined in claim 7 wherein said n-type semiconductor grains are selected from the group consisting of ZnO, CdS, $WO_3$ and $TiO_2$ and mixtures thereof.

9. A method as defined in claim 7 or 8 wherein said organic binder exhibits charge carrier conveying capability.

10. A method as defined in any of claims 7 or 8 wherein M in said general formula designates germanium and/or silicon.

11. A method as defined in claim 7 wherein said bismuth oxide-based compound oxide is represented by said general formula in which M designates germanium, x denotes 12, and n denotes 20.

12. A method as defined in claim 7 wherein said bismuth oxide-based compound oxide is represented by said general formula in which M designates silicon, x denotes 12, and n denotes 20.

13. A method as in claim 7 including the step, after step (c), of heat-treating the X-ray sensitive layer at a temperature within the range no lower than the softening point of said organic binder but below the temperature at which said organic binder begins decomposing.

* * * * *